US011691372B2

(12) United States Patent
Staempfli

(10) Patent No.: US 11,691,372 B2
(45) Date of Patent: Jul. 4, 2023

(54) TOOL INSTALLATION AID

(71) Applicant: Feintool International Holding AG, Lyss (CH)

(72) Inventor: Marc Staempfli, Lyss (CH)

(73) Assignee: Feintool International Holding AG, Lyss (CH)

( * ) Notice: Subject to any disclaimer, the term of this patent is extended or adjusted under 35 U.S.C. 154(b) by 691 days.

(21) Appl. No.: 16/843,875

(22) Filed: Apr. 8, 2020

(65) Prior Publication Data

US 2020/0324502 A1 Oct. 15, 2020

(30) Foreign Application Priority Data

Apr. 10, 2019 (EP) ..... 19168429

(51) Int. Cl.
*B30B 15/02* (2006.01)
*B21J 13/08* (2006.01)

(52) U.S. Cl.
CPC ..... *B30B 15/028* (2013.01); *B21J 13/085* (2013.01); *Y10T 483/1729* (2015.01)

(58) Field of Classification Search
CPC ..... Y10T 483/1726; Y10T 483/1729; Y10T 483/1731; B30B 15/026; B30B 15/028; B21D 28/16; B21D 37/00; B21D 37/04; B21D 37/14; B21D 37/147
USPC ..... 483/27, 28, 29; 100/214, 224, 229 R, 100/918; 72/448
See application file for complete search history.

(56) References Cited

U.S. PATENT DOCUMENTS 2,176,543 A * 10/1939 Norton ..... B21D 43/13 83/563
3,368,479 A 2/1968 Gregorovich
3,677,121 A * 7/1972 Etchell ..... B41D 5/00 83/437.1
3,859,929 A * 1/1975 Korn ..... B61C 9/44 105/131
3,935,811 A * 2/1976 Lenz ..... B21D 37/14 72/448
3,986,448 A * 10/1976 Seyfried ..... B21D 37/14 72/448

(Continued)

FOREIGN PATENT DOCUMENTS

CN 101722674 A 6/2010
CN 106607671 A 5/2017

(Continued)

*Primary Examiner* — Erica E Cadugan
*Assistant Examiner* — Michael Vitale
(74) *Attorney, Agent, or Firm* — Norris McLaughlin, P.A.

(57) ABSTRACT

A tool installation aid for installing a tool into a press includes a holding console attachable to a press, and a tool-changing plate in or on which a tool is attachable, wherein the tool-changing plate can be placed onto a receiving element of the holding console, a drive device, drivable by a motor or manually, is disposed in the tool-changing plate and by way of which the tool-changing plate is displaceable on the receiving element in the direction toward the press to be transferred from the receiving element onto the clamping plate of the press, the drive device includes at least one driven first drive element, and the receiving element includes at least one non-driven second drive element, the first and second drive elements being operatively connected for displacing the tool-changing plate.

8 Claims, 6 Drawing Sheets

(56) References Cited

U.S. PATENT DOCUMENTS

| | | | | | |
|---|---|---|---|---|---|
| 4,301,673 | A * | 11/1981 | Yonezawa | B21D 37/14 | 72/448 |
| 4,317,358 | A * | 3/1982 | Yonezawa | B21J 13/085 | 72/448 |
| 4,395,944 | A | 8/1983 | Siepermann et al. | | |
| 4,614,108 | A | 9/1986 | Bolle et al. | | |
| 4,630,536 | A * | 12/1986 | Shah | B30B 15/028 | 72/448 |
| 4,664,037 | A * | 5/1987 | Piepenbreier | F16D 3/68 | 105/131 |
| 5,113,684 | A | 5/1992 | Oster | | |
| 5,129,254 | A * | 7/1992 | Keizer | B30B 15/028 | 72/448 |
| 9,908,695 | B1 * | 3/2018 | Thompson | B65F 1/1468 | |
| 10,350,667 | B2 | 7/2019 | Nishida | | |
| 2006/0223687 | A1 * | 10/2006 | Hedin | B30B 15/028 | 483/28 |
| 2017/0239704 | A1 * | 8/2017 | Nishida | B21D 37/14 | |

FOREIGN PATENT DOCUMENTS

| | | | | |
|---|---|---|---|---|
| CN | 108687231 | A * | 10/2018 | B21D 37/08 |
| CN | 109382447 | A * | 2/2019 | |
| CN | 109570367 | A * | 4/2019 | |
| DE | 198 50 999 | C1 | 6/2000 | |
| DE | 20 2010 003 703 | U1 | 9/2010 | |
| DE | 11 2015 004 660 | T5 | 7/2017 | |
| GB | 1472 819 | A | 5/1977 | |

* cited by examiner

FIG. 1b"

TOOL INSTALLATION AID

BACKGROUND OF THE INVENTION

The invention relates to a tool installation aid for installing a tool into a press, and in particular a fine blanking press.

Such tool installation aids are essentially known from the prior art. These are used to transfer a tool of a press by way of a tool-changing plate, in or on which the tool is attached, into a press, and in particular onto a press table or the clamping plate of the press, so as to put the tool in the press into operation. This is provided, for example, when an existing tool is worn and has to be replaced with a new tool. In light of the considerable weight of the tools and the tool-changing plate, such a replacement cannot be carried out purely manually. Rather, a tool-changing plate is transferred from a region in front of the press into the press by way of a drive device, in particular a motor drive device, which displaces the tool-changing plate, in a horizontal plane, into the press.

According to the present state of the art, drive devices for transferring tool-changing plate are separate units, which are expensive and require a great deal of space in the region in front of the press. Such drive devices can be designed as motor-driven push link chains, which exert a pushing force on the tool-changing plate so as to displace this into the press, in particular onto the clamping plate thereof.

SUMMARY OF THE INVENTION

In light of this described background, it is an object of the invention to provide a tool installation aid that can be of a less expensive design and requires less space, in particular no additional space at all, in a region in front of the press.

This object is achieved by a tool installation aid that comprises a holding console, which can be attached to the body/frame of a press and moreover comprises a tool-changing plate, in or on which a tool to be replaced can be attached, in particular in the recess of which a tool to be replaced can be inserted, wherein the tool-changing plate can be placed onto a receiving element of the holding console.

It may be provided in this regard that the receiving element, with a region supporting the tool-changing plate, is disposed in the same plane as the receiving plane of the clamping plate of the press onto which the tool is to be transferred, together with the tool-changing plate. According to the invention, the tool-changing plate can thus be transferred from the receiving element in the direction of, and onto, the clamping plate of the press, after the holding console has been attached to the press.

According to the invention, it is furthermore provided that a drive device, in particular a drive device drivable by a motor or manually, is disposed in the tool-changing plate, by way of which the tool-changing plate can be displaced on the receiving element, in particular transported in the direction toward the body/frame, and preferably can be transferred from the receiving element onto the clamping plate of the body/frame.

It is furthermore provided according to the invention that the drive device of the tool-changing plate comprises at least one driven first drive element, and the receiving element comprises at least one non-driven second drive element, which are operatively connected for displacing the tool-changing plate. Even though the second drive element itself is not driven so as to move the tool-changing plate, it is referred to as a drive element since it represents a part of the kinematic drive train that is used to move the tool-changing plate. The at least one second drive element is thus a passive element, which is idle, which is to say stationary, during the movement of the tool-changing plate.

A significant difference between the invention and the prior art is that the drive for moving the tool-changing plate is not separate from the tool-changing plate, but rather a drive device is integrated into the tool-changing plate in the invention. The aforementioned at least one first drive element can be driven in relation to the receiving element, in particular directly, by way of this drive device, for example when the drive device of the tool-changing plate already comprises a motor, or at least indirectly, for example when a motor is not integrated into the tool-changing plate, but is external in relation thereto.

In the latter case, indirect driving may take place, for example, in such a way that a driving force or a driving torque is transmitted to the tool-changing plate by an external motor, or by a manually actuatable element, for example by way of a coupling element on the tool-changing plate, wherein the drive device of the tool-changing plate is provided to transmit the force or the torque to the at least one first driven drive element. The drive device of the tool-changing plate can thus be designed as a force or torque transmission system, such as a gearbox, for transmitting a force or torque between the coupling element and the at least one first drive element.

The operative connection between the at least one driven first drive element and the non-driven at least one second drive element on the receiving element causes force or torque transmission between the tool-changing plate and the receiving element, so that the tool-changing plate can be moved relative to the receiving element, which is idle in relation to the press, as a result of this transmission.

Due to the at least partial integration of the drive device, which is to say, if necessary, excluding the motor or a manual actuating element, into the tool-changing plate, the requirements with regard to the necessary installation space for the drive device in front of the press are reduced.

Moreover, the complexity for the force transmission between the drive device and the tool-changing plate is reduced, since the components necessary therefor, in particular gearbox components, are included in the tool-changing plate. In particular, a motor for driving the tool-changing plate does not have to be disposed in a stationary manner with respect to the press since, in the invention, the force acting for the driving motion develops between the tool-changing plate and the receiving element, which, in turn, is connected to the press. The driving forces thus, in actuality, act directly between the tool-changing plate and the press. In this way, a motor can also be moved along with the tool-changing plate.

In a particularly preferred embodiment, the invention can provide that the at least one non-driven second drive element can be moved out of an idle position into a working position, wherein the at least one second drive element is only operatively connected to the at least one first drive element in the working position.

The idle and working positions are preferably positions assumed by the at least one second drive element on the receiving element. The drive element can be transferred between the two positions, for example, by way of a translatory and/or also rotatory movement relative to the receiving element. Since no operative connection is present between the at least one first and second drive elements in the idle position, this idle position may be intended, for example, for placing the tool-changing plate onto the receiving element, such that it is initially freely displaceable on the receiving element, in particular in the horizontal direction.

When the at least one second non-driven drive element is transferred from the idle position into the working position, the operative connection between the at least one first and second drive elements is established, and in particular these engage with one another in the process. The tool-changing plate is no longer freely displaceable thereafter, but is now displaceable with the integrated drive device thereof in the direction toward the press and away from the press.

In a preferred refinement, the invention can provide that at least one driven front first drive element and at least one driven rear first drive element, with respect to the displacement direction, in particular the direction toward the press, are disposed on the tool-changing plate, wherein the front and rear first drive elements are driven synchronously. The front and rear first drive elements are both part of the drive device of the tool-changing plate. In this way, the force or torque for moving the tool-changing plate on at least two driven first drive elements spaced apart from one another in the displacement direction can be transmitted to a non-driven second drive element, which, in particular, evenly distributes the force transmission to multiple locations.

This offers the advantage that it is possible to provide, in one refinement, that the at least one front first drive element and the at least one rear first drive element are simultaneously operatively connected to the same second drive element in a first displacement region, in particular an initial displacement region, and only the at least one rear first drive element is operatively connected to the second drive element in a second displacement region following the first in the displacement direction. During the transfer of the tool-changing plate, the at least one front first drive element can thus become disengaged from the second drive element, wherein driving continues to be ensured by way of the at least one rear first drive element. In this way, no force interruption occurs, even though the tool-changing plate moves out on the receiving element.

It is particularly advantageous when, in the second displacement region, the at least one front first drive element can be brought into operative connection with at least one third non-driven drive element on the press, and in particular, with the tool installation aid attached to a press, is operatively connected to at least one third non-driven drive element of the press.

During the transfer to the press, the front first drive element thus becomes disengaged from the second drive element and becomes operatively connected to a third non-driven drive element of the press, in particular while the at least one rear first drive element is continuously operatively connected to the second drive element.

It is further preferred that, in a third displacement region that follows the second displacement region in the displacement direction, the at least one front and rear first drive elements are not operatively connected to the at least one second drive element, and in particular in the third displacement region, with the tool installation aid attached to the press, the at least one front and rear first drive elements are simultaneously operatively connected to at least one third non-driven drive element on the press.

The tool-changing plate thus moves from the receiving element into the press, wherein the driving force is initially only supported on the receiving element, then on the receiving element and the press at the same time, and ultimately is only supported on the press.

The invention can preferably provide that at least one front and at least one rear first drive element are disposed in each case on the tool-changing plate, on each of the two side walls located opposite one another and extending parallel to the displacement direction, which, in particular, are operatively connected to at least one respective second drive element disposed on the receiving element along the respective side wall, for displacement.

In this way, the tool-changing plate can be moved particularly well in the desired displacement direction without tilting.

In an embodiment having a preferred design, the invention provides that the at least one first drive element is, and in particular the at least one front and rear first drive elements are, designed as a driven gear wheel, and the at least one second drive element, and in particular also the third drive element, is designed as a toothed rack in meshing engagement therewith.

In one possible design, the receiving element thus comprises two mutually opposing toothed racks as second non-driven drive elements, between which the tool-changing plate is disposed, wherein front and rear gear wheels, protruding in relation to the toothed rack and meshing therewith, are provided as the respective first driven drive element in a respective side wall of the tool-changing plate, which is located opposite a respective toothed rack. The driving forces are thus transmitted from the tool-changing plate to the outside on at least four points, initially only to the receiving element, then to the receiving element and the press, and thereafter only to the press. Toothed racks are disposed opposite one another in the press as the respective third drive element such that the toothed racks of the third and second drive elements are oriented so as to align with one another and are positioned synchronously in terms of the teeth.

The respective toothed rack of the second drive element can preferably be pivotable about a rotational axis, which is parallel to the displacement direction and parallel to the toothed rack extension, out of the idle position into the working position.

The driven front and rear gear wheels of the first drive elements on the two side walls of the tool-changing plate are, further preferably, each attached to a shared first drive shaft, and each first drive shaft is coupled, at the rear end thereof in the displacement direction, to a second drive shaft that is perpendicular thereto, in particular by way of bevel gears. Via a rotatable coupling element, which is disposed on an end wall of the tool-changing plate located perpendicularly to the side walls, a rotational movement, which is generated manually or by a motor, can be transmitted to the second drive shafts, in particular by way of a gear, such as an angular gear or worm gear. Using a motor attached to the coupling element or a crank handle, a rotation of all at least four gear wheels can be brought about, which are disposed at the front and rear, in the displacement direction, on a respective side wall of the tool-changing plate.

The receiving element can be attached, in an articulated manner, to support braces of the holding console. So as to attach the holding console to a press, the receiving element can, for example, be pivoted 90 degrees out of an initially parallel position between two preferably vertical support braces, and then be fixed, for example by fixing struts, which each extend between the lower end of the support brace and the end of the receiving element facing away from the press.

At the end facing the press, the receiving element can comprise attachment elements, which, in particular, protrude in the direction toward the press and which can engage in corresponding attachment elements of the press.

A preferred embodiment will be described in more detail based on the figures. All the figures show the same embodiment of the invention in different views, so that the figures overall are described hereafter collectively.

DETAILED DESCRIPTION OF THE INVENTION

Shown is a tool installation aid, comprising a holding console 1, for a press, which is shown together with a portion of the press here.

The holding console 1 comprises two vertical support braces 1*b*, at the upper ends of which a receiving element 1*a* is attached in an articulated manner, so that the receiving element 1*a* can be folded out into the horizontal position shown here. The horizontal alignment of the receiving element 1*a* is secured by way of the fixing struts 1*c*. The holding console 1 is formed of the receiving element 1*a*, the support braces 1*b* and the fixing struts 1*c*.

The two vertical support braces 1*b* of the holding console 1 are fixedly connected to the press stand 2, i.e., the frame or body of the press. The receiving plane 1*e* can be aligned using the two eccentric bolts 1*b*, by way of which the fixing struts 1*c* are connected at the lower ends thereof to the support braces 1*b*. The receiving plane 1*e* is aligned with the plane of the press table or the clamping plate 2*a*. The receiving plane 1*e* here is the plane tangent to the upper extremity of the rollers 1*f* of the receiving element 1*a*. A tool-changing plate 3 can be moved on these rollers 1*f* in the direction toward the press stand 2.

Figure 1A:
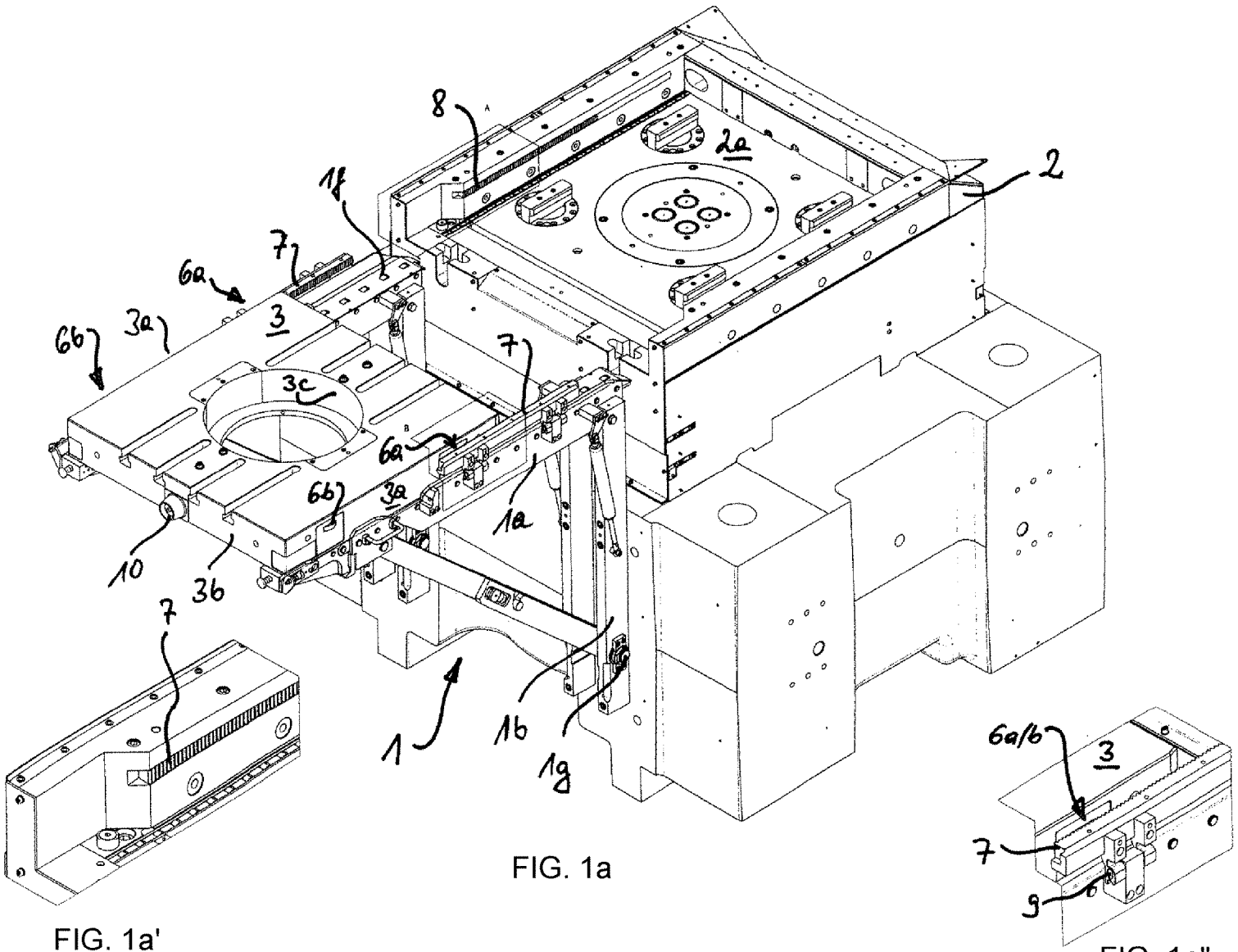
FIG. 1*a* shows a perspective view of the tool installation aid on a press with the tool-changing plate in a starting position, and FIG. 1*a*' and FIG. 1*a*" show details of the tool installation aid enlarged relative to FIG. 1*a;*
Figure 3A:
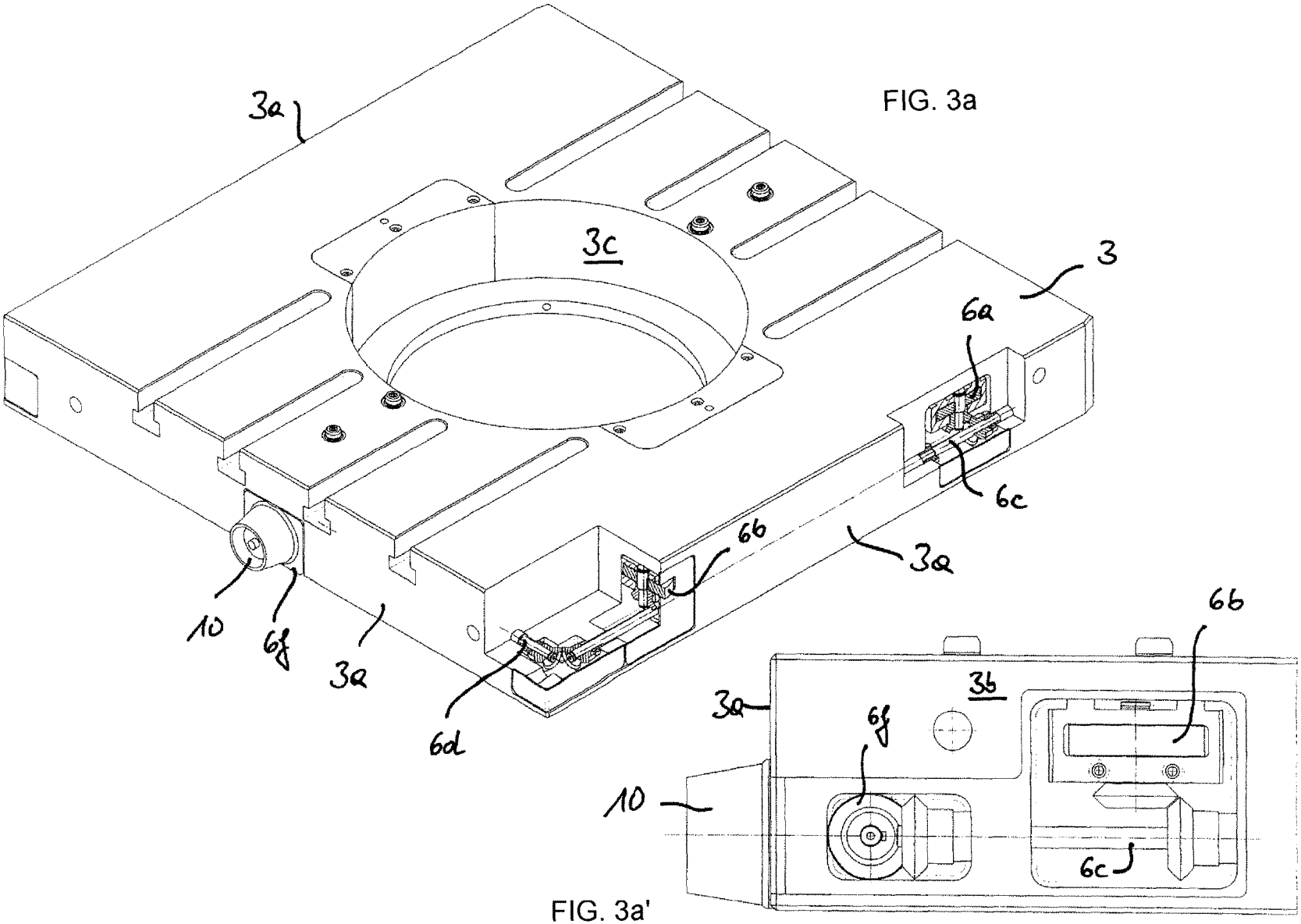
FIG. 3*a* shows the tool-changing plate without the tool, and FIG. 3*a*' shows details of the tool-changing plate enlarged relative to FIG. 3*a*.
Figure 3B:
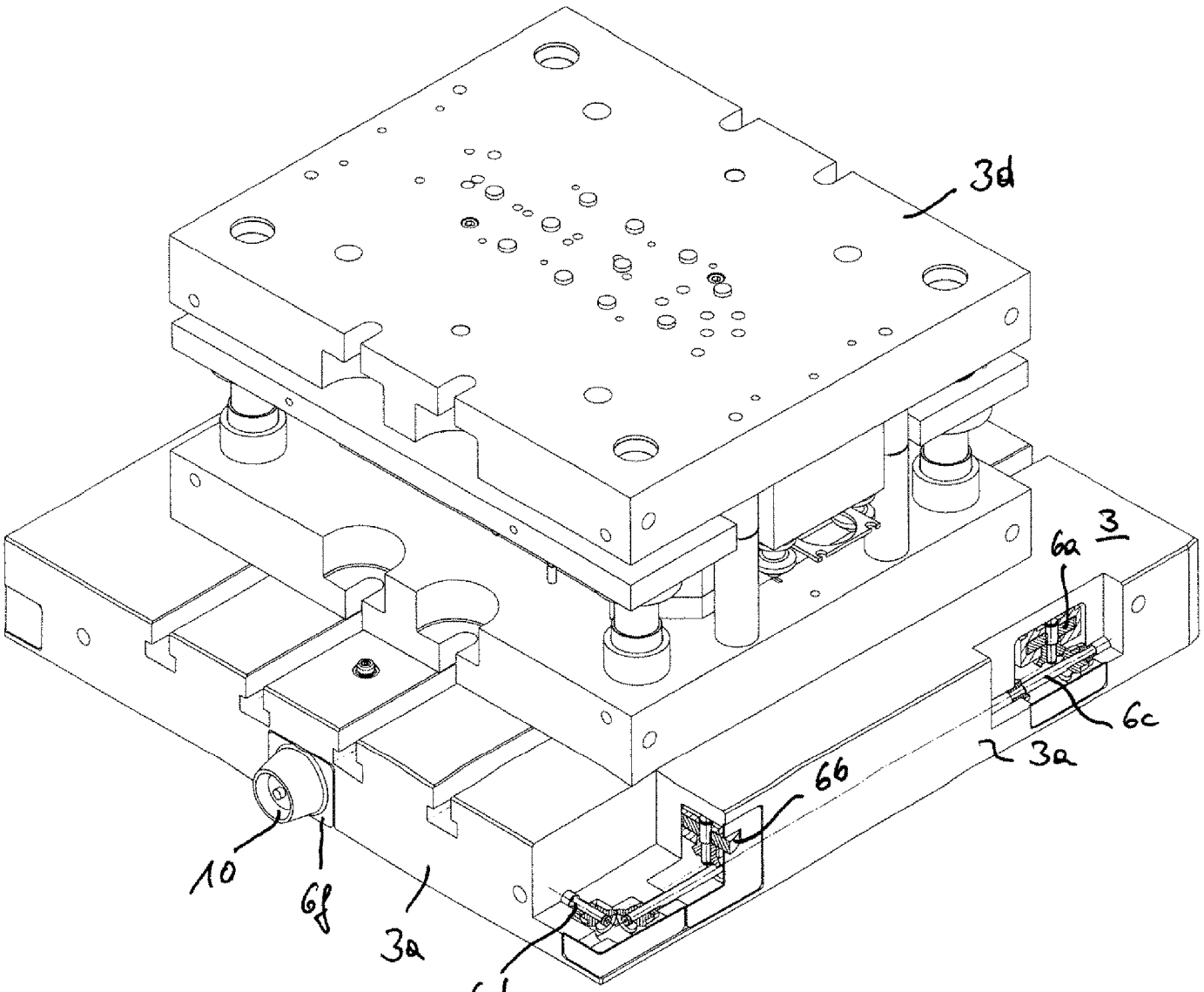
FIG. 3*b* shows the tool-changing plate with the tool.

In the embodiment shown in FIGS. 1*a*, 1*a*', 1*a*", 1*b*, 1*b*', 1*b*", 1*c*, 2*a*, 2*b*, 3*a* and 3*a*', the tool-changing plate 3 includes a recess 3*c* on, or via, which a tool can be attached, which is not shown in these figures. FIG. 3*b*, by way of example, shows the design of a possible tool 3*d* that is attached to the tool-changing plate 3 and, together with the same, can be moved into the press and out of the same.

Two gear wheels are disposed in each of the two side walls 3*a* of the tool-changing plate 3, wherein the gear wheel 6*a* is disposed at the front, and the gear wheel 6*b* is disposed at the rear, with respect to the displacement direction facing the press. The gear wheels 6*a* and 6*b* in each of the two side walls 3*a* thus form front and rear first driven drive elements. These are driven synchronously by the shafts 6*c* and 6*d*, which can be made to rotate by way of the coupling element 10 on the end face 3*b* facing away from the press 2. For this purpose, a crank handle or a motor can be applied to the coupling element, for example. The coupling element 10 comprises a gearbox 6*f*, which causes the two shafts 6*d* parallel to the end wall to rotate, which, in turn, drive the shafts 6*c* by way of bevel gears in the corners of the tool-changing plate 3.

Respective toothed racks 7, which are disposed on the receiving element 1*a* and can be pivoted there, about the rotational axes 9 between an idle position and a working position, extend parallel to the side walls 3*a*. In the working position, the gear wheels 6 mesh with the toothed racks 7. As a result of a rotation of the shaft in the coupling element 10, the gear wheels 6 can thus all be made to rotate synchronously, so that these can move forward, or backward, in the toothed racks 7, in the direction toward the press, and thereby move the tool-changing plate 3 forward or backward.

Figure 1B:
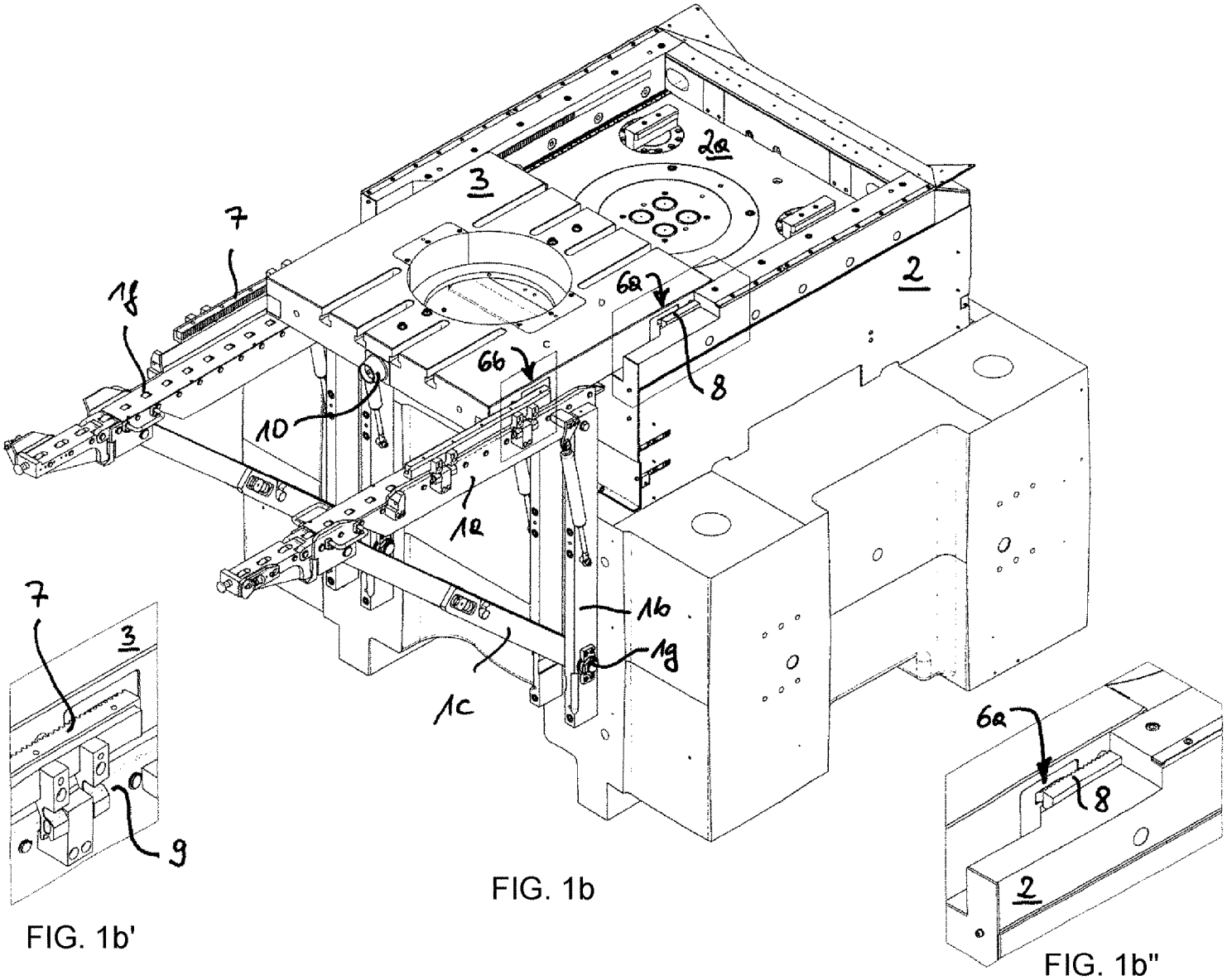
FIG. 1*b* shows a perspective view of the tool installation aid on a press with the tool-changing plate in a transition position, and FIG. 1*b*' and FIG. 1*b*" show details of the tool installation aid enlarged relative to FIG. 1*b;*

During a movement in the direction toward the press, the front gear wheels 6*a* become disengaged from the respective toothed racks 7 starting at a particular movement range, while the rear gear wheels 6*b* remain engaged and ensure the advancement. The front gear wheels 6*a* then become engaged with the toothed racks 8 on the press 2 above the clamping plate 2*a*, so that the driving force or the driving torque is transmitted directly onto the press. The associated position of the tool-changing plate is shown in FIG. 1*b*.

Figure 1C:
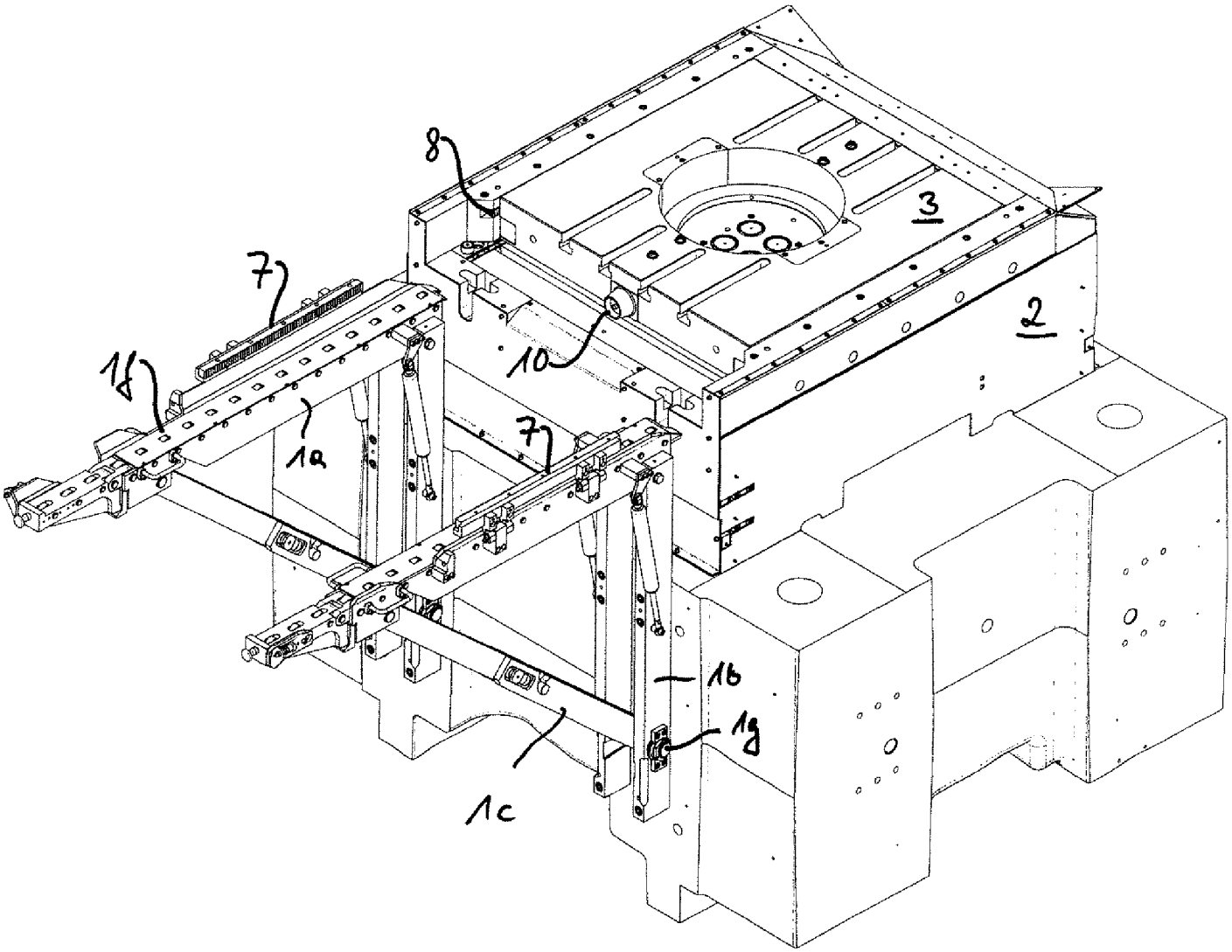
FIG. 1*c* shows a perspective view of the tool installation aid on a press with the tool-changing plate in the end position.
Figure 2B:
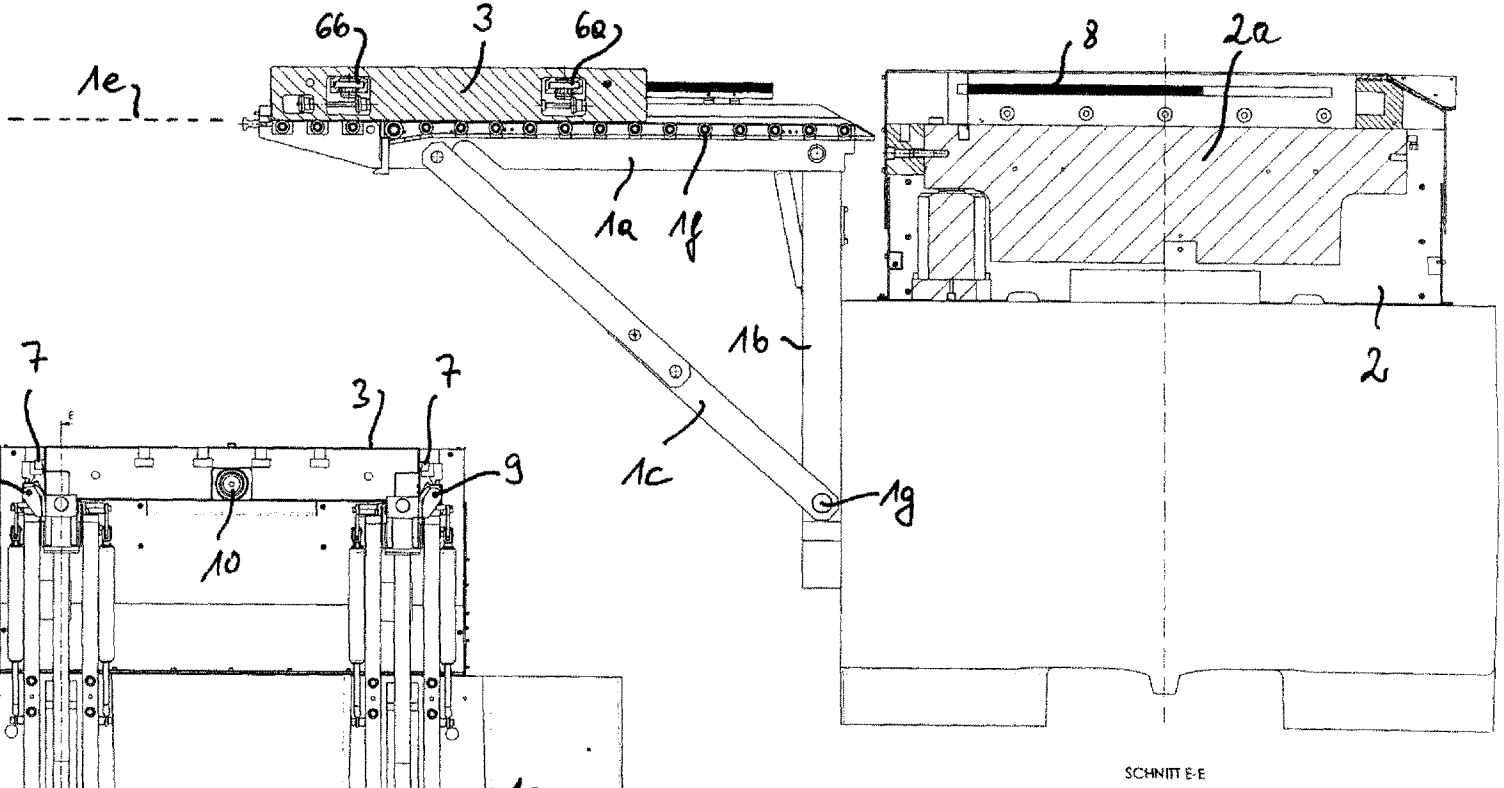
FIG. 2*a* and FIG. 2*b* show, respectively, front and side elevation views of the tool installation aid on a press with the tool-changing plate in a starting position.
Figure 2A:
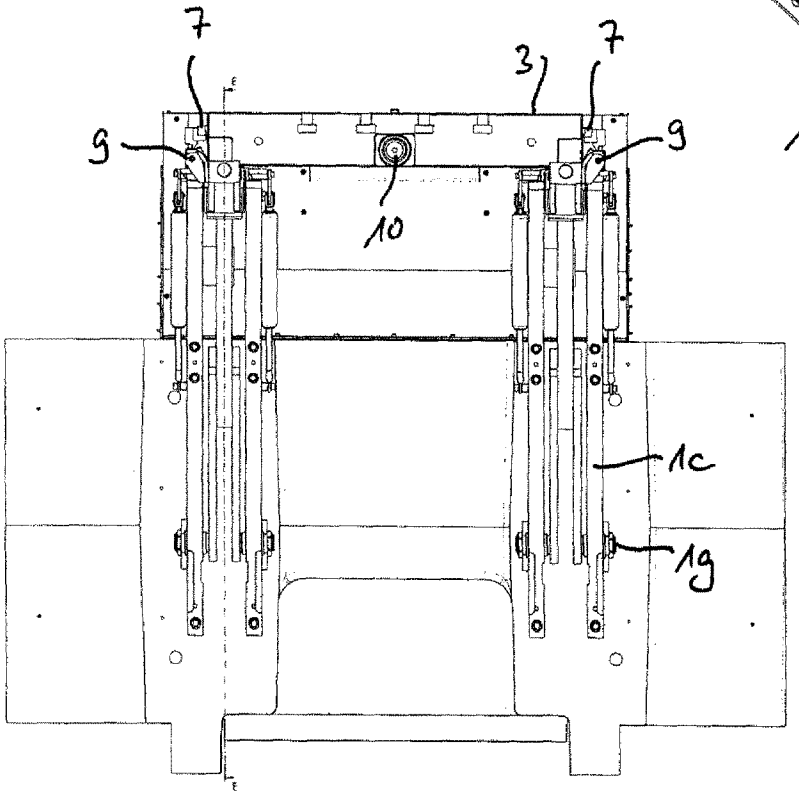

Thereafter, the rear gear wheels 6*b* become disengaged from the toothed racks 7, wherein further driving is thereafter carried out solely by way of the front gear wheels 6*a*, which are already meshing with the toothed racks 8. Thereafter, the rear gear wheels 6*b* also become engaged with the toothed racks 8. The end position achieved then is shown in FIG. 1*c*.

The described transfer of a tool, which is not shown, with the tool-changing plate 3 can also take place in the reverse direction and manner.

It is apparent from the figures that, except for the space for the holding console composed of support braces 1*b*, receiving element 1*a* and the fixing struts 1*c*, no additional space is required for a drive unit. A motor can be provided, for example, in a simple embodiment as a cordless screwdriver or compressed air motor having essentially no installation space requirement. A motor can also be configured as a drive secured by dual channels.

Compared to the prior art, the invention thus has a very compact design and is inexpensive to implement, since the essential components of the drive device are already integrated into the tool-changing plate, and the driving forces/torques act directly between the tool-changing plate and the receiving element or the press, and do not require any external support. Moreover, the receiving element 1*a*, when not needed, can be folded against the press frame 2 in a space-saving manner.

The invention claimed is:

1. A tool installation aid for installing a tool into a press, comprising:

a holding console configured to be attached to the press;

a tool-changing plate configured to have attached therein or thereon the tool to be transported to a table or a clamping plate of the press, wherein the holding console comprises a receiving element configured to receive the tool-changing plate and the tool-changing plate is configured to be received by the receiving element, a drive device disposed in the tool-changing plate and configured to be driven by a motor or be driven manually to displace the tool-changing plate on the receiving element in a direction toward the press and transfer the tool-changing plate from the receiving element onto the table or the clamping plate of the press, wherein the drive device of the tool-changing plate comprises at least one driven first drive element, the receiving element comprises at least one non-driven second drive element, and the at least one driven first drive element and the at least one non-driven second drive element are operatively connected for displacing the tool-changing plate in the direction toward the press, wherein the at least one driven first drive element comprises at least one each of respective front and rear driven first drive elements, and each of the at least one front driven first drive elements comprises a respective driven front gear wheel, and each of the at least one rear driven first drive elements comprises a respective driven rear gear wheel, and each of the at least one non-driven second drive element and a non-driven third drive element comprises a respective toothed rack configured for meshing engagement with the respective driven front and rear gear wheels, and the toothed rack of each of the at least one non-driven second drive elements is pivotable between an idle position and an working position about a rotational axis which extends parallel to a displacement direction of the tool-changing plate in the direction toward the press and further parallel to a lengthwise direction of the toothed rack of each of the at least one non-driven second drive elements.

2. The tool installation aid according to claim 1, wherein the at least one non-driven second drive element is operatively connected to the at least one driven first drive element only in the working position.

3. The tool installation aid according to claim 2, wherein the at least one front driven first drive element and the at least one rear driven first drive element are configured to be simultaneously operatively connected to the at least one non-driven second drive element in an initial region of displacement of the tool-changing plate in the direction toward the press, and only the at least one rear first drive element is configured to be operatively connected to the at least one non-driven second drive element in a second displacement region that follows the first displacement region in the direction of displacement of the tool-changing plate.

4. The tool installation aid according to claim 3, wherein the holding console is attached to the press and the non-driven third drive element is disposed on the press, wherein the at least one front driven first drive element is configured to be brought into operative connection with the non-driven third drive element on the press.

5. The tool installation aid according to claim 4, wherein the at least one front and rear driven first drive elements are configured so that, in a third displacement region that follows the second displacement region in the direction of displacement of the tool-changing plate toward the press, the at least one front and rear driven first drive elements are not operatively connected to the at least one non-driven second drive element and are operatively connected to the non-driven third drive element on the press.

6. The tool installation aid according to claim 5, wherein the at least one driven first drive element comprises, on each of opposite, mutually parallel side walls of the tool-changing plate, a respective one of the at least one front driven first drive element and a respective one of the at least one rear driven first drive element, the at least one front and rear driven first drive elements being front and rear with respect to the displacement direction of the tool-changing plate toward the press, and wherein the at least one non-driven second drive element disposed on the receiving element comprises respective ones of the at least one non-driven second drive elements extending parallel to the respective side walls of the tool-changing plate.

7. A tool installation aid for installing a tool into a press, comprising:

a holding console configured to be attached to the press;

a tool-changing plate configured to have attached therein or thereon the tool to be transported to a table or a clamping plate of the press, wherein the holding console comprises a receiving element configured to receive the tool-changing plate and the tool-changing plate is configured to be received by the receiving element, a drive device disposed in the tool-changing plate and configured to be driven by a motor or be driven manually to displace the tool-changing plate on the receiving element in a direction toward the press and transfer the tool-changing plate from the receiving element onto the table or the clamping plate of the press, wherein the drive device of the tool-changing plate comprises at least one driven first drive element, the receiving element comprises at least one non-driven second drive element, and the at least one driven first drive element and the at least one non-driven second drive element are operatively connected for displacing the tool-changing plate in the direction toward the press, wherein the at least one driven first drive element comprises at least one each of respective front and rear driven first drive elements, and each of the at least one front driven first drive elements comprises a respective driven front gear wheel, and each of the at least one rear driven first drive elements comprises a respective driven rear gear wheel, and each of the at least one non-driven second drive element and a non-driven third drive element comprises a respective toothed rack configured for meshing engagement with the respective driven front and rear gear wheels, and the drive device of the tool-changing plate further comprises first drive shafts and second drive shafts extending perpendicular to each other and respective bevel gears coupling each respective one of the first drive shafts, at a rear end thereof relative to a displacement direction of the tool-changing plate in the direction toward the press, to a respective one of the second drive shafts, and the respective driven front and rear gear wheels of each respective one of the at least one driven first drive elements are each attached to a respective one of the first drive shafts, and the drive device of the tool-changing plate further comprises a rotatable coupling element, the rotatable coupling element comprising a gearbox and being disposed on an end wall of the tool-changing plate, the end wall being perpendicular to side walls of the tool-changing plate and being at a rear end of the tool-changing plate relative to the displacement direction, the rotatable coupling element being configured so that a rotational movement, generated manually or by the motor and applied to rotate the rotatable coupling element, is transmitted to the second drive shafts by way of the gearbox.

8. The tool installation aid according to any one of claims 1, 2, 3-6 and 7, wherein the holding console comprises articulated support members attached to the receiving element and configured to support the receiving element.

* * * * *